US006550168B1

(12) United States Patent
Campos

(10) Patent No.: US 6,550,168 B1
(45) Date of Patent: Apr. 22, 2003

(54) PROMOTIONAL DISPLAY WITH FLUID MOVEMENT

(76) Inventor: Victor Salas Campos, 201 NW. 35th Ct., Oakland Park, FL (US) 33309

( * ) Notice: Subject to any disclaimer, the term of this patent is extended or adjusted under 35 U.S.C. 154(b) by 0 days.

(21) Appl. No.: 09/851,525

(22) Filed: May 8, 2001

Related U.S. Application Data

(63) Continuation-in-part of application No. 09/357,038, filed on Jul. 20, 1999, now abandoned.

(51) Int. Cl.[7] ..... G09F 19/00

(52) U.S. Cl. ..... 40/406; 40/407; 40/427; 40/439; 40/480; 446/176; 446/267

(58) Field of Search ..... 40/406, 407, 427, 40/436, 439, 440, 441, 477, 480; 446/267, 176

(56) References Cited

U.S. PATENT DOCUMENTS 1,782,328 A * 11/1930 Wearham ..... 40/446
3,101,564 A * 8/1963 Stoessel ..... 40/407
3,706,149 A * 12/1972 Oliveri ..... 40/407
5,617,657 A * 4/1997 Kahn ..... 239/17
5,737,860 A * 4/1998 Whigham et al. ..... 40/406
5,791,078 A * 8/1998 Maranto et al. ..... 40/406
5,819,452 A * 10/1998 Hakkert ..... 40/219
5,979,091 A * 11/1999 TenBrink ..... 40/410
6,119,382 A * 9/2000 Hakkert ..... 40/406
6,187,394 B1 * 2/2001 Johnson et al. ..... 119/245
6,256,911 B1 * 7/2001 Duarte Vieira ..... 40/406

* cited by examiner

*Primary Examiner*—Lynne H. Browne
*Assistant Examiner*—James M. Hewitt
(74) *Attorney, Agent, or Firm*—Malloy & Malloy P.A.

(57) ABSTRACT

A display assembly intended primarily but not exclusively for use in the advertisement of any of a variety of different products or services structured to visually simulate the presence of moving liquid representative of an effervescent or bubbling liquid in the advertisement or display. An ornamental display, in the form of a pictorial representation, indicia, or other visual representation includes a light transmittable material aligned with an illumination assembly and a chamber through which a pattern of fluid flow passes. The pattern of fluid flow comprises a plurality of air streams of bubbles and provides the appearance of moving liquid to an exterior observer.

33 Claims, 5 Drawing Sheets

PROMOTIONAL DISPLAY WITH FLUID MOVEMENT

CLAIM OF PRIORITY

The present application is a continuation-in-part application of previously filed, now abandoned application having Ser. No. 09/357,038, filed on Jul. 20, 1999.

BACKGROUND OF THE INVENTION

1. Field of the Invention

This invention relates to a display assembly which can be used to display or advertise any of a variety of products or services and particularly designed to incorporate a visual simulation of moving liquid in the displayed product or service. The simulated image of moving liquid may be more specifically representative of a carbonated or effervescent beverage and is accomplished by introducing air under pressure to a quantity of fluid which is disposed in aligned relation with a pictorial, ornamental representation or like indicia depicting the product or service being displayed.

2. Description of the Related Art

Display assemblies in the form of signs or like structures have been utilized for many years for the promotion and advertisement of an infinite number of products and services. As time progressed the signs became more sophisticated in terms of more accurately depicting the product or service being advertised. In years past, typical advertising signs included an exposed surface with indicia, representative of the product or service being promoted, painted, printed or otherwise formed thereon.

As society progressed and modernized, the advertising industry as well as proprietors of a variety of businesses, also progressed to the extent of modernizing the signs or display assemblies utilized in promoting the various products or services. As a result, display assemblies became more sophisticated, such as by adding illumination both internally and externally, to advertising signs and like display structures, thereby generally enhancing the appearance, as well as more realistically representing the various products or is services being displayed. In current times the design and manufacture of advertising and like display structures have developed into a well recognized and sophisticated industry which is required to effectively customize an extremely large number of display assemblies, dependent upon the particular product or service being advertised. In addition, the specific and individualized requirements of a wide variety of different businesses must be satisfied. Extensive technical development in this area has resulted in overcoming the vast majority of problems associated with the accurate depiction of any given product or service. More specifically, modern design, manufacturing and/or production capabilities have advanced to the point where the majority of advertising or other display structures clearly and accurately represent the product or service being advertised. In addition, aesthetic improvements have been developed which cause the visual attention of the consuming public to be focused on the sign structure being displayed.

Therefore, a primary goal in the advertising industry, as well as the industry associated with the design and manufacture of advertising displays, is to visually distinguish a given display assembly in a manner which will direct the attention of the consuming public to the particular article, product or service being displayed and will make the product appear more desirable. Focusing the attention of the consuming public is particularly important, in light of the fact that numerous display assemblies which may be in the same general vicinity are also highly developed and are attempting to directly compete in focusing the attention of those consumers.

Accordingly, there is a significant need in the display and advertising industries for an improved type of display assembly capable of presenting a visual display of a large variety of goods and/or services in a uniquely distinctive manner, which greatly facilitates the focusing of the attention of the viewing public on the image being displayed and which enhances the overall appeal towards the product generated by the depiction.

SUMMARY OF THE INVENTION

This invention relates to a display assembly adapted to display and/or advertise any of an extremely large number of products, goods, services, etc. and particularly designed to visually simulate the presence of moving liquid, preferably but not necessarily, in the form of an effervescent or carbonated beverage, thereby increasing the appeal of that beverage.

More specifically, the display assembly of the present invention comprises a housing which may have a variety of structural designs, dimensions, configurations, etc. so as to be readily adaptable to a variety of different mountings or applications. For example, the housing of the display assembly of the present invention could be specifically structured for attachment to or mounting on a vending or dispensing machine for carbonated beverages, such as soft drinks. The soft drink product being displayed would be presented on an exposed surface of the vending machine and pictorially represented as a "real life" carbonated beverage moving within or being poured from a bottle or other container. Indeed, the realistic depiction would not only draw a consumers attention to the advertisement, but will also increase the products appeal to the potential consumers senses of sight and/or sound.

Regardless of the particular structural configuration assumed by the housing, the display assembly of the present invention further includes an exposed face, preferably defined by an outer surface of a plastic, or other applicable material, sheet or panel. An ornamental configuration, including indicia in the form of a pictorial representation, alpha-numeric display, or other visual representation depicting the product or service being displayed and/or advertised is formed on a viewable portion on the exposed surface. At least a portion of the exposed face and particularly a portion disposed in aligned relation with the aforementioned indicia, is formed from a transparent, translucent or like light transmittable material.

The display assembly of the present invention further includes a chamber mounted on or within the housing in aligned relation with the exposed face and particularly disposed in aligned relation with the indicia formed thereon. A fluid is contained within the chamber and may comprise a plurality of substances having a variety of different viscosities and colors, dependent on the particular visual effect desired to be accomplished, as set forth in greater detail hereinafter. The viscosity of the fluid may vary from a viscosity equal to water to a much higher viscosity, somewhat equal to a gel. A material capable of being used within the chamber includes but is not limited to a petrochemical such as a petrolatum. In any such embodiment, however, the display assembly is configured to achieve an environmentally safe configuration.

An illumination assembly is also mounted on or within the housing and is disposed so as to direct light through the fluid and at least a portion of the chamber containing the fluid, which is also at least partially formed of light transmittable material. Moreover, the illumination may also pass through the indicia and the exposed face on which the indicia is formed. Accordingly, visual observation of the indicia and more particularly of the fluid disposed in aligned relation with light transmittable portions of the indicia, will provide a visual simulation of a liquid product or beverage. The provision of the illumination assembly makes the contained fluid more visible and greatly enhances the features of a displayed product such as, but not limited to, carbonated characteristics of a beverage.

Another feature of the present invention is the provision of a flow fluid supply assembly. The flow fluid supply assembly is disposed in fluid flow communication with the fluid contained within the chamber. As a result, at least one but preferably a plurality of streams of flow fluid, such as air, are delivered directly into the fluid within the chamber, thereby forming a predetermined, preferably random pattern of air flowing through the fluid which, depending upon the particular image intended to be depicted, may include a large concentration of bubbles ascending from a lower part of the fluid to the upper surface thereof.

Accordingly, the display assembly of the present invention will provide an observer, located exteriorly and at least partially in front of the exposed face, with a visual simulation of a liquid product or beverage, or other pictorial representation of a moving liquid, which may be in the form of an effervescent or carbonated beverage type product.

The display assembly of the present invention comprises yet another preferred embodiment differing both structurally and operationally from the embodiments as described above but intended to be included within the spirit and scope of the present invention. More specifically, the display assembly of this preferred embodiment comprises a housing having an illumination assembly mounted thereon and including an outer exposed panel defining an outer face or surface of the housing. The panel is made in whole or in part from a transparent or other light transmittable material. Further, the panel is disposed in overlying relation to an ornamental display.

In this embodiment there is at least one but preferably a plurality of ornamental displays, each of which are independently and selectively movable into aligned relation with the exposed panel face. In such an aligned position, the ornamental display is viewable through the exposed panel by an exterior observer. By way of example only, each of the one or more ornamental displays may be defined by a two dimensional or three dimensional structure affixed to or integrally formed on a movable, somewhat flexible material sheet or like structure. The sheet may be mounted between oppositely disposed drive rollers, at least one of which is driven by a drive motor or other means to facilitate a selective positioning of a selected ornamental display into aligned, viewable relation with and through the outer exposed panel.

As with the previously described embodiments, the display assembly of this preferred embodiment is specifically structured to visually simulate moving fluid or liquid and may be used in advertising or otherwise displaying a liquid container having a variety of different beverages. Naturally, one or more ornamental displays depicting other types of moving liquids may also be represented by an appropriate pictorial representation.

This additional preferred embodiment also comprises a casing having liquid contained therein. The liquid is provided in sufficient quantity, along with the dimension and configuration of the casing itself, to provide the intended visual simulation of moving liquid or fluid to an exterior observer. The liquid may be anyone of a plurality of liquids wherein the viscosity may vary dependent, at least in part, on the visual display and impression that is intended.

One feature of the present invention is the provision of a fluid regulating assembly connected to the casing and disposed in fluid communication with the interior thereof and the liquid contained therein. The fluid regulating assembly is specifically structured to allow the introduction of a fluid flow, preferably ambient air, into the liquid so as to create a predetermined pattern of fluid flow there through. The pattern of fluid flow is defined by a substantially planar array of a plurality of "bubble streams" passing from the fluid flow regulating assembly, normally located at or adjacent to the bottom of the casing, upwardly towards the upper end of the casing.

In order to assure a consistent and continuous pattern of fluid flow through the liquid, this preferred embodiment of the display assembly of the present invention further includes a source of negative pressure connected in fluid communication with the interior of the casing. The source of negative pressure thereby creates a sufficient amount of negative pressure within the interior of the casing to force the pattern of fluid flow or plurality of bubble streams upwardly, from the fluid regulating assembly, through the liquid to an upper space within the casing which is substantially devoid of the aforementioned liquid. It should be apparent that as long as the negative pressure is maintained within the casing the pattern of fluid flow will continue and thereby provide the intended visual simulation of moving liquid to an observer looking through the outer exposed surface panel and aligned ornamental display.

As previously described the ornamental display includes a transparent, translucent or like light transmittable material which is structured to facilitate viewing of the predetermined flow pattern of bubble streams passing through the liquid. The visual simulation of moving liquid being a part of the ornamental display, such as liquid within a bottle or other container or a variety of other pictorial representations is thereby accomplished. Moreover, another feature of this preferred embodiment of the display assembly of the present invention comprises the ability to vary the appearance of the pattern of fluid flow through the liquid.

More specifically, the fluid regulating assembly comprises a plurality of valves each disposed in flow regulating relation with one of a plurality of inlets through which fluid such as, but not limited to, ambient air passes as it flows into the liquid and forms the pattern of fluid flow. By regulating (opening and closing) the operation of individual ones of the plurality of valves, the pattern of fluid flow through the liquid may be varied. Changing the configuration of the pattern of fluid flow in this manner changes the overall visual appearance of the moving liquid, as observed through the ornamental display from an external location. Accordingly, the appearance of the ornamental display may also be changed.

Other features capable of varying the overall visual simulation of moving liquid includes changing or regulating the illumination assembly in order to vary the color and lighting of the liquid within the casing. In addition, the liquid itself may vary in color so as to further enhance or change the intended visual appearance. Also, the amount of negative pressure maintained within the casing may be increased or decreased thereby controlling the rate of travel of the pattern of fluid flow through the liquid.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As shown in the accompanying drawings, the present invention is directed to a display assembly, generally indicated as 10. The display assembly 10 includes a housing 12 which may have a variety of structural configurations, dimensions, etc. so as to make it readily adaptable for mounting to or securement on a number of different locations, such as but not limited to, a dispensing or vending machine, billboard, storefront, truck panel, etc.

Figure 1:
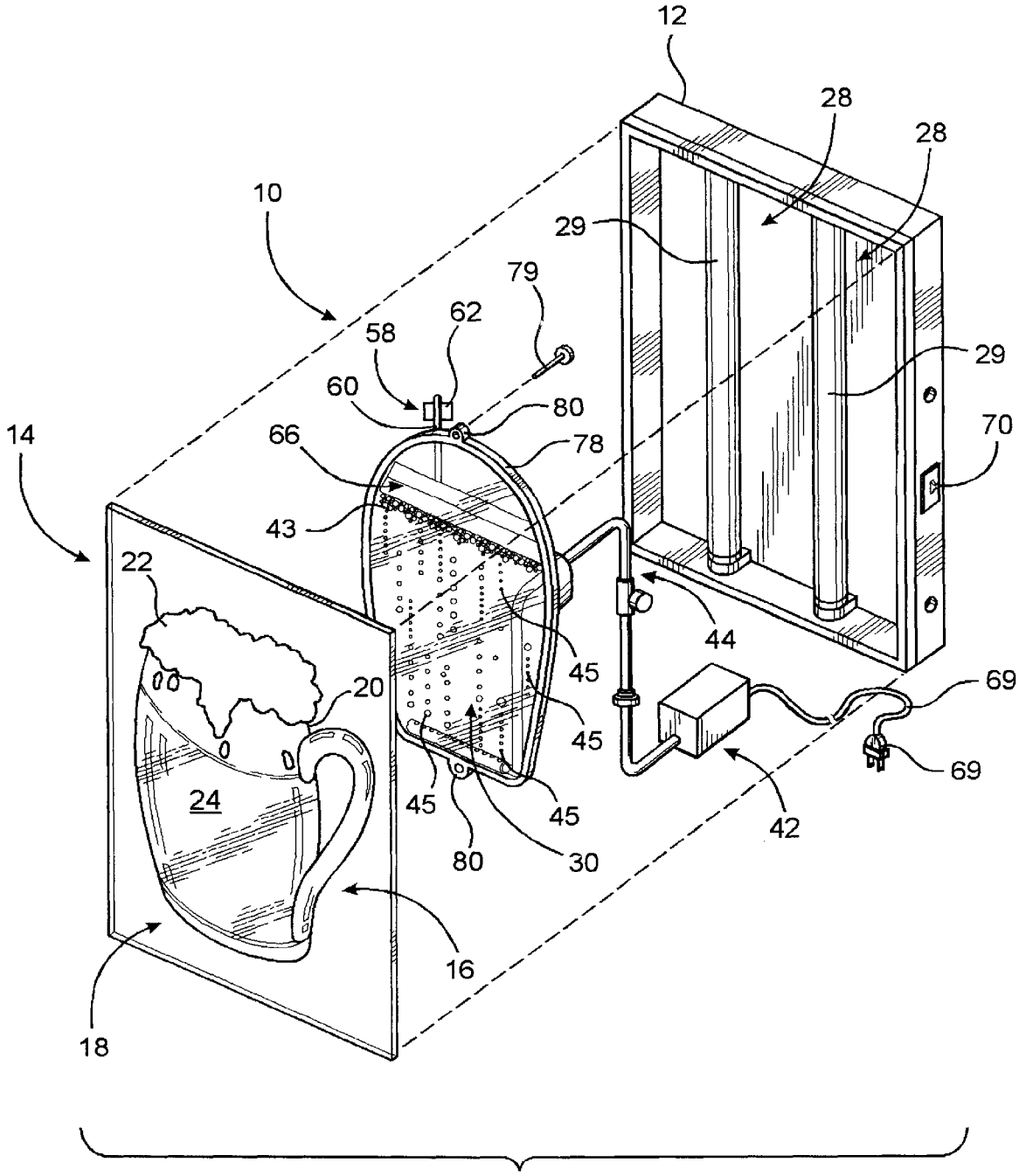
FIG. 1 is a perspective view in exploded and at least partial cutaway form of the display assembly of the present invention.

The display assembly 10 of the present invention further comprises a front panel, generally indicated as 14. The front panel 14 is preferably formed of a plastic or other at least semi-rigid material. Moreover, the material is preferably moldable so as to facilitate the formation thereof into a variety of two or three dimensional configurations and orientations. The front panel 14 includes an exposed face 16 having a predetermined ornamental configuration 18, and preferably a quantity of indicia, defined thereon. The ornamental configuration 18 preferably comprises indicia including a pictorial representation and/or alpha-numeric display, such as informative writing, printing, etc. or any other type of visual representation which depicts an image such as the goods, products, services, etc. being advertised or displayed. In the embodiment of FIG. 1, and by way of example only, the ornamental configuration 18 is in the form of a mug, bottle, glass or like fluid containment article 20 filled with a beverage having a foam top or head 22 that enhances the overall appearance. Indeed, the indicia of the ornamental configuration 18 is preferably defined in combination with a shape and/or contour of at least a portion of the front panel 14 so as to enhance a preferably realistic three dimensional look, such as the aforementioned mug, or a another fluid containment article 20 such as a pitcher, bottle, can, cup, pool, etc. Within the context of the present invention, the beverage is preferably represented as being carbonated or effervescent and is viewable through at least a portion of the front panel 14, such as that portion 24 that represents at least part of the body of the mug or glass like container 20. Therefore at least a portion of the front panel 14 and particularly at least some portion or area of preferred the ornamental configuration 18, as at 24, is formed of a light transmittable material. The term "light transmittable" as used herein is meant to include a material which is entirely or partially transparent, translucent or a combination thereof such that light can generally be transmitted or viewed through the material, and more specifically so that an intended degree of visual observation there through and/or through the ornamental configuration 18 is possible.

Along these lines, the present display assembly further includes an illumination assembly, generally indicated as 28. The illumination assembly 28 greatly facilitates such viewing and will be described in greater detail hereinafter. It is emphasized that other portions of the front panel 14, generally, and the exposed face 16 specifically, may also be formed from a light transmittable material structured to allow various degrees of viewing there through.

Figure 2:
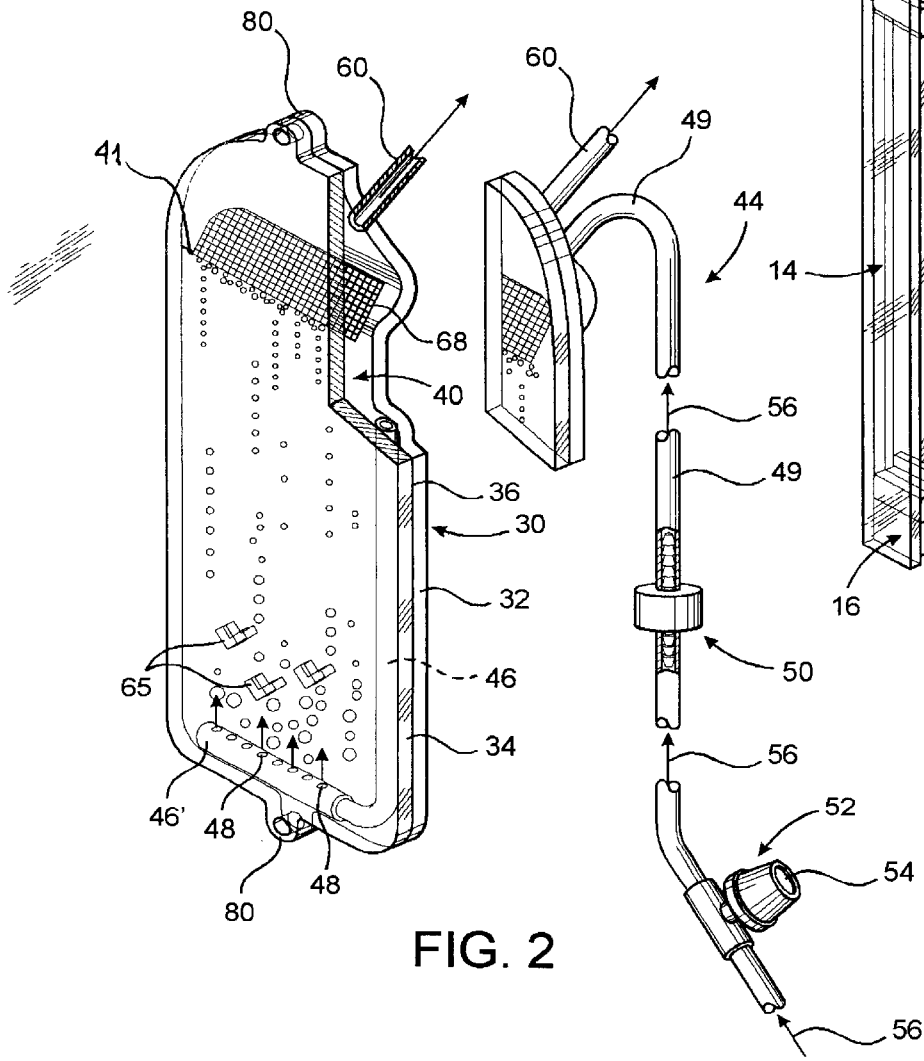
FIG. 2 is a perspective view in partial cutaway showing details of certain components of the embodiment of FIG. 1.

Another feature of the present invention is the provision of a chamber 30 shown in detail in FIGS. 1 and 2. The chamber 30 is formed from a flexible, semi-rigid or substantially rigid material, which is at least partially light transmittable. In one embodiment of the present invention, as best shown in FIG. 2, the chamber 30 comprises two chamber segments 32 and 34 each in the form of a flexible or semi-rigid sheet sealed to one another along a common periphery, as at 36, such that the interior 38 of the chamber 30 is substantially sealed.

A fluid, generally indicated as 40, is contained within the interior 38 of the chamber 30, and may or may not include a pigment and can have any one of a variety of different viscosities. The viscosity of the fluid 40 will have a direct effect on a pattern and/or rate of a flow fluid, such as air, flowing through the fluid 40 and the appearance of the product represented, as will be explained in greater detail hereinafter. In the preferred embodiments, the viscosity of the fluid may vary between that of water to that of a gel so long as a degree of gas permeability is exhibited thereby. Such a fluid may include, but is not limited to, a petrochemical including a petrolatum.

As set forth above, a flow fluid such as air or another gas or fluid is introduced directly into the fluid 40 by means of a flow fluid supply assembly, generally indicated as 42. The flow fluid supply assembly 42 may be in the form of an air or other fluid compressor or motor, or alternatively a pump capable of directing a fluid, such as air, under at least a minimal amount of pressure, through a delivery conduit generally indicated as 44. Accordingly, the term "compressor" is meant to include a variety of different structures, each of which is capable of forcing or releasing air or any other flow fluid such as another gas or fluid under a predetermined and/or pre-selected amount of pressure and in predetermined quantities, through the delivery conduit 44 directly into the fluid 40 maintained within chamber 30. Of course, it is understood that the pressure may indeed be minimal if the natural tendency of the flow fluid is to rise through the heavier fluid 40. The delivery conduit 44 preferably comprises a first conduit segment 46 located at least partially on the interior of the chamber 30 and having at least a certain portion of the length thereof submerged or in direct fluid flow engagement with the fluid 40.

The preferred first conduit segment 46 includes a delivery portion 46'. The delivery portion 46' of the delivery conduit 44 is preferably disposed at a lower end or area within the fluid 40 and at least in communication with the interior 38 of the chamber 30. In such a location the flow fluid exits from the delivery portion 46' and naturally ascends to the upper surface 41. The pattern of flow fluid passing through the fluid 40 may be in the form of a predetermined pattern, but is preferably completely random and is at least partially determined by the provision of an apertured construction formed in the delivery portion 46' and/or a sequential portion of the "fluid compressor". In the illustrated embodiment, the apertured construction comprises a plurality of spaced apart apertures 48, specifically disposed and dimensioned, to allow a plurality of separate streams of flow fluid to flow therefrom. The reaction of flow fluid with the fluid will thereby cause a plurality of "bubble streams" 45 which will, in certain instances, provide the desired predetermined, random pattern and visual simulation of a carbonated and/or effervescent beverage to one who is viewing the fluid 40 from a location exterior of the exposed face 16 and through the light transmittable material which at least partially covers the fluid 40. It is emphasized that the disposition, dimension and configuration of the delivery portion 46' of the delivery conduit 44 may be greatly varied or altered, so as to provide for a variety of the predetermined patterns or arrays of flow streams or "bubble streams" 45 passing or ascending through fluid 40. In addition, the viscosity of the fluid 40 will have a distinct affect on the developed pattern and the visual image depicted thereby. More specifically, the higher the viscosity of the fluid 40, the slower the ascension or passage of the plurality of streams of bubbles 45 will be as the bubbles pass through the fluid 40. In turn the pressure and/or quantity of the flow fluid exiting from the plurality of apertures 48 into the fluid 40 may be varied or controlled to accommodate the viscosity of the fluid 40 and provide a pre-selected pattern or array of bubbles, dependent on the visual simulation intended to be depicted while exteriorly viewing the fluid 40. Additionally, so as to further enhance the realistic appearance of the flow fluid passing through the chamber, a disperser assembly preferably including one or more disperser articles 65 are disposed throughout the chamber, in a preferably random array. The disperser articles 65 function to divide and/or deviate the normal flow of the bubbles of flow fluid, thereby further enhancing the random, realistic appearance of the pattern, reducing the overall size of the bubbles as need to a more realistic relative size, and effectively increasing the concentration of bubbles within the fluid 40. Of, course, it is understood that although the preferred disburser article includes a series of small, preferably pointed segments as illustrated, other configurations including panel segments and/or further smaller apertures disposed throughout the chamber so as to further control or randomize the flow pattern could also be employed.

The delivery conduit 44 also preferably includes a second conduit segment 49 located exteriorly of the chamber 30 and disposed to establish fluid communication between the flow fluid supply assembly 42 and the interior 38 of the chamber 30. A regulating assembly is connected to the delivery conduit 44 along the length of the second conduit segment 49. Such flow regulating assembly preferably includes a one way check valve 50 specifically structured to prevent the back flow of fluid 40 from the interior 38 of the chamber 30 outwardly from the chamber 30 along the length of the second conduit segment 49. Also, the flow regulating assembly includes an adjustably structured flow regulator, generally indicated as 52 including an adjustable control knob 54. The flow regulator 52 is specifically disposed and structured to regulate the volume and/or pressure of the flow of flow fluid, indicated by directional arrow 56 from the flow fluid supply assembly 42 to the interior 38 of the chamber 30 through the delivery conduit 44.

An additional structural feature associated with the display assembly 10, and more particularly with the chamber 30, includes a vent assembly, generally indicated as 58. The vent assembly 58 includes a vent conduit 60 establishing fluid communication between the interior 38 of the chamber 30 and the exterior thereof. The vent assembly 58 also preferably includes a pressure activated check valve 62 disposed and structured to vent flow fluid from the interior 38 of the chamber 30 if the pressure on the interior 38 reaches a certain, pre-selected amount. The valve 62 will automatically cause a venting of an excess volume of flow fluid, such as preferably air, contained within the chamber 30 and remain open until the pressure within the interior 38 of the chamber 30 is reduced to or below a pre-selected value.

A control assembly, generally indicated as 66, is provided preferably in the form of a plate, panel or like device 68 preferably having a net-like or open mesh configuration. The control device 68 is mounted on the interior 38 of the chamber 30 in preferably immediately adjacent relation to the fluid surface 41. Orientation or position of the control device 68 may be varied so as to regulate the flow fluid issuing from the surface 41 subsequent to its passage or extension through the interior of the fluid 40 from the delivery portion 46'. More specifically, the control device 68 is provided to regulate the amount of bubbles collecting on the surface 41 in order to reduce, eliminate or otherwise control the appearance and the presence of foam 43 on the surface 41. It is recognized that in certain instances, such as when advertising or displaying a beer or soft drink, a certain amount of foam or accumulated collection of bubbles 43 may be desirable for viewing, to further simulate the product represented. In such instances the position or orientation of the control device 68 may be adjusted to either increase, decrease or otherwise regulate the presence of the foam or bubble collection 43.

As set forth above, another structural feature of the present invention is the inclusion of an illumination assembly 28 which, in the embodiment of FIG. 1, is represented by at least one but preferably a plurality of flourescent tubes 29. At least some of the illumination elements 29 are at least partially disposed on or within the housing 12 so as to direct sufficient quantities of illumination directly through the chamber 30, the fluid 40 contained therein, and also through the light transmittable material portions of the front panel 14. Accordingly, in order to provide the proper visual simulation, the entire chamber 30 and/or predetermined designated portions thereof are also formed of a light transmittable material which may include a transparent, translucent or variable combination of both.

Both the illumination assembly 28 as well as the flow fluid supply assembly 42 may be electrically powered from a common source of electrical energy interconnected to the housing 12 by a somewhat conventional electric cord and plug structure, collectively indicated as 69. An activating switch 70 may be mounted in an exposed location on the housing 12 or at another more convenient location and is interconnected by somewhat conventional circuitry to regulate current flow to the illumination assembly 28 and the flow fluid supply assembly 42, as well as any other structural components of the display assembly 10 which may be electrically powered. Moreover, if the article on which the display assembly 10 will be utilized is already powered, such powering may be utilized for the display assembly 10 as well.

Figure 3:
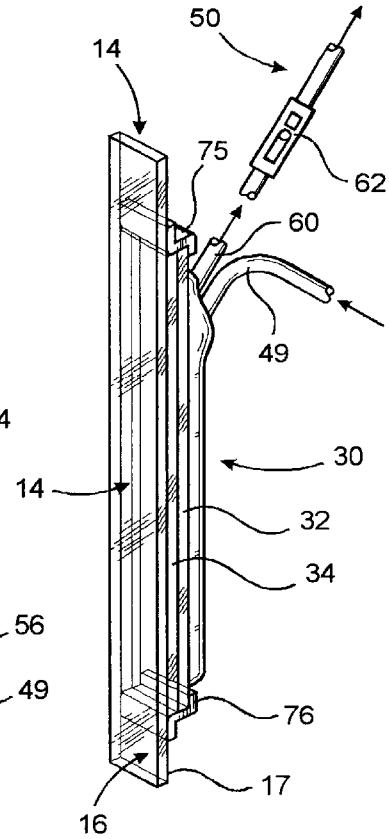
FIG. 3 is perspective view of certain components of the embodiment of FIG. 1 shown in assembled form.

With primary reference to both FIGS. 1 and 3, another feature of the present invention is the positioning of the chamber 30 in direct alignment and preferably in overlying and/or at least partially covering relation to the ornamental configuration 18 of the exposed surface or at least the light transmittable portions thereof. Accordingly, the configuration and dimension of the chamber 30, as well as the quantities and dispersal of the fluid 40 therein, is such as to dispose the chamber 30 and fluid 40 in aligned and possibly, but not necessarily, somewhat covering or overlying relation to at least the light transmittable material portions 24 of the ornamental configuration 18 mounted on the front panel 14.

The illumination directed from the illumination assembly 28 will thereby efficiently and effectively pass through the chamber 30, fluid 40 and intended portion 24 of the ornamental configuration 18 and/or front panel 14, in order to provide an effective visual simulation of moving liquid which may preferably be representative of carbonated or effervescent beverages. To accomplish such preferred alignment or overlying relation, the chamber 30 may be secured directly to the inner surface 17 of the front panel 14 at which the ornamental configuration 18 is defined. Mounting in the manner described can be accomplished by spaced apart brackets 75 and 76 or, as shown in FIG. 1 can also be accomplished by a support frame 78 disposed in supporting and somewhat surrounding relation to the chamber 30. The support frame 78 may be connected to the surface 17 of the front panel 14 by means of one or more somewhat conventional connectors 79 passing through connector receiving portions 80 formed and/or connected to the support frame 78. Alternately, and as emphasized as FIG. 2, the connector receiving portion 80' may be secured directly to the chamber 30.

Yet another preferred embodiment of the present invention is shown in FIG. 4 through 9 and is generally indicated as 10'. Similar structural features between all of the embodiments of the present invention include the provision of a housing 12 having an illumination assembly 28 defined by at least one but preferably a plurality of individual illumination bulbs such as flourescent bulbs 29. It is emphasized that the illumination assembly 28 can of course vary in location and structure so as to provide a selection of different visual effects, as will be described in greater detail hereinafter.

The display assembly 10' also includes an outer panel 14' defining an exposed face or surface 16' of the display assembly 10'. The cover panel 14' is removably secured to an outer exposed portion of the housing 12 and is at least partially formed from a transparent, translucent or other light transmittable material so as to allow viewing there through of at least one of a plurality of ornamental displays 18. As also disclosed with the previous embodiment, the display assembly 10' includes a casing 30' having a display liquid 40 contained therein. The liquid 40 may vary in viscosity and range from a water like liquid to a gel-like substance, all of which are intended to be described and defined by the term "liquid". When operative, the illumination assembly 28 passes light as at 29' (see FIG. 9) through the interior 38' of the casing 30' so as to illuminate the liquid 40. Through such illumination a pattern of fluid flow comprising a plurality of bubbles or bubble streams 45, is also illuminated. The ornamental display 18 is disposed in overlying and substantially aligned relation with the casing 30' which in turn is aligned with the illumination assembly 28, as set forth above. Accordingly, an observer, located on the exterior of the housing 12 may easily view the ornamental display 18 through the exposed surface 16' of the cover panel 14' and be exposed to a visual simulation of moving liquid being apart of the ornamental display 18. As described above the ornamental display 18 may be in the form of various indicia or some type of pictorial representation including, but not limited to, a liquid container or vessel as disclosed in both FIGS. 1 and 4.

As set forth above, the display assembly 10' comprises at least one but preferably a plurality of ornamental displays 18. Each of the one or more ornamental displays 18 are movably positioned so as to be disposed in aligned relation between the exposed surface or face 16' and the casing 30'. The user of the display assembly 10' therefore is provided with the versatility of quickly and easily changing the ornamental display 18' to anyone of a plurality of pictorial displays, indicia, etc.

Figure 4:
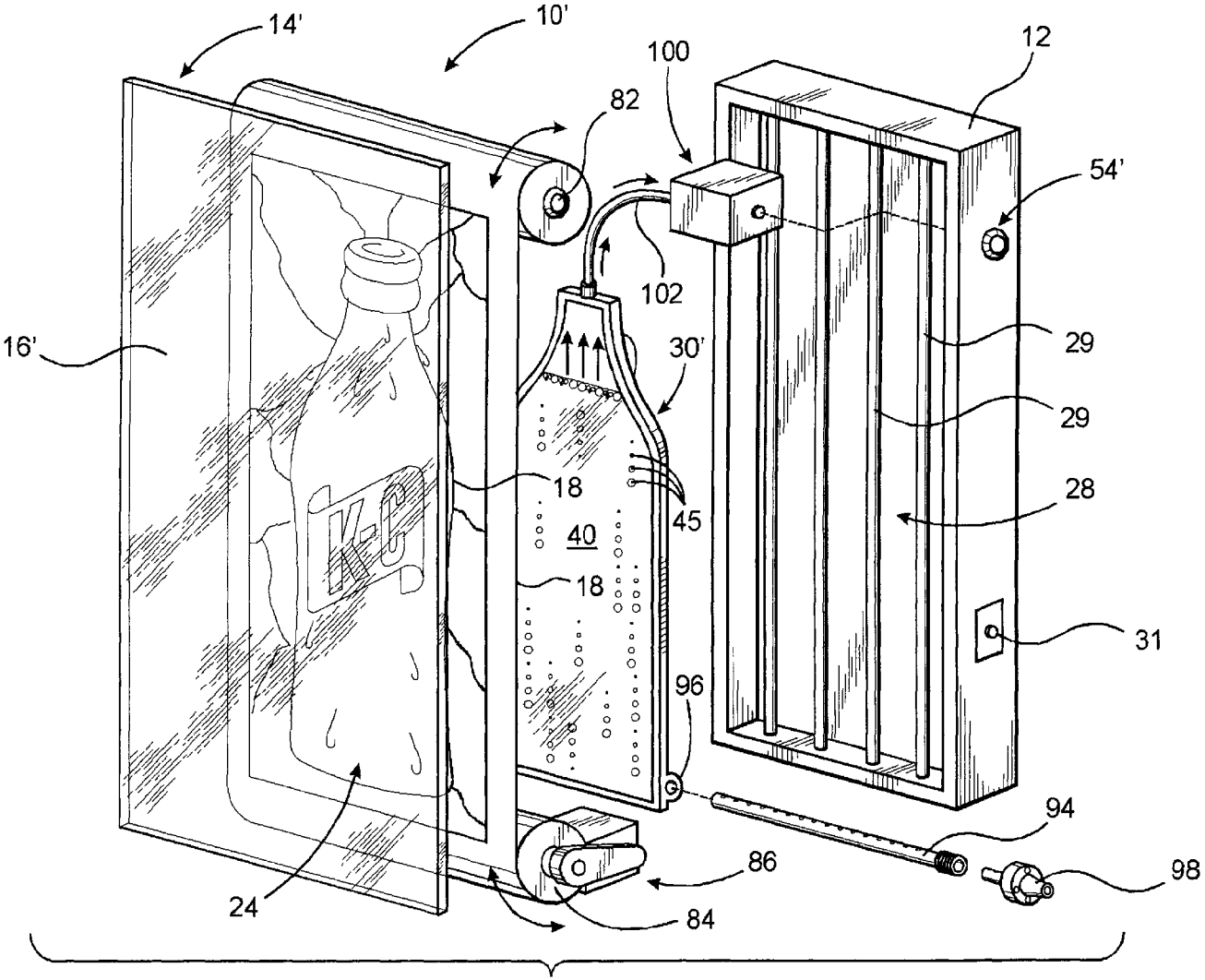
FIG. 4 is a perspective view in exploded form of another preferred embodiment of the display assembly of the present invention.

In the embodiment of FIG.4 the two dimensional or three dimensional pictorial displays 18 may be integrally or fixedly mounted on an at least partially flexible sheet 80 having its opposite ends connected to one or more drive rollers as at 82 and 84. A drive motor as at 86 is attached in driving relation to at least one of the drive rollers 82 and 84. As such the sheet 80 may move along and be positioned in opposite directions. Any one of the plurality of ornamental displays 18 may therefore be disposed in aligned relation with the casing 30, liquid 40, predetermined pattern of fluid flow 45 and illumination assembly 28. For purposes of clarity only a single ornamental display 18 is depicted in the embodiment of FIG. 4.

Figure 5:
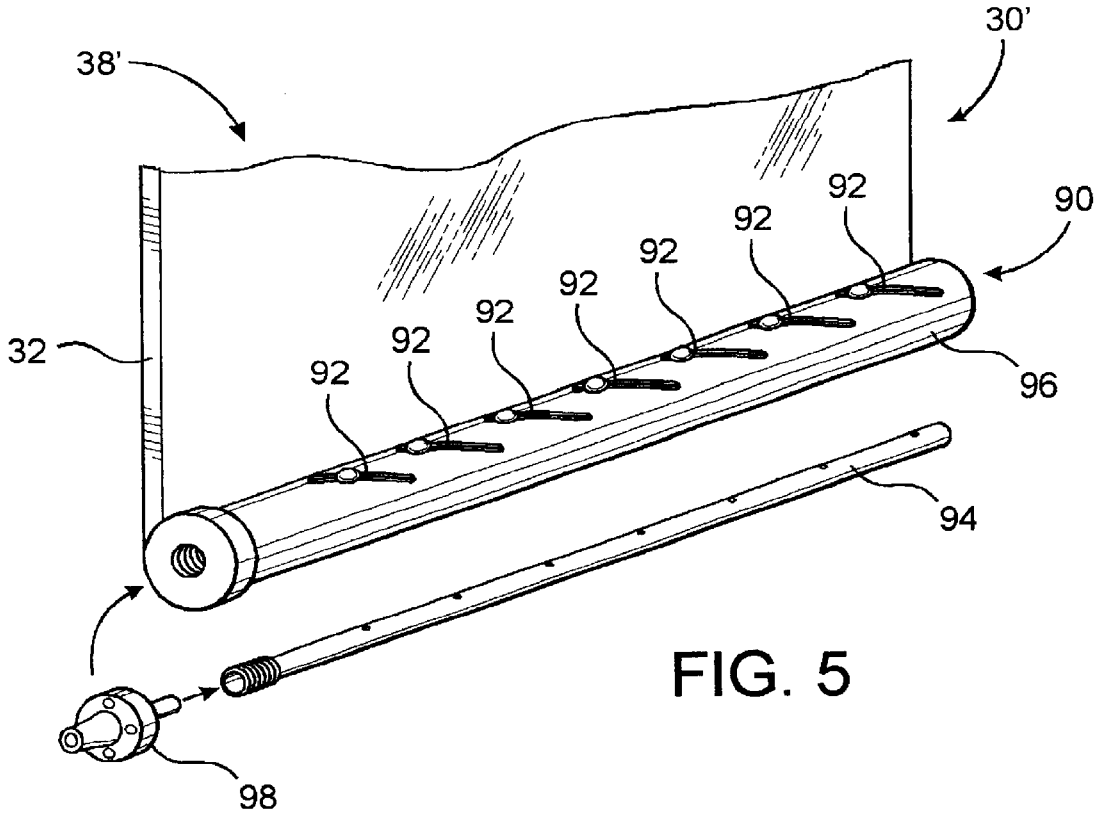
FIG. 5 is a detailed perspective view in partial cutaway of a fluid regulating assembly associated with the preferred embodiment of FIG. 4.

Another feature of the display assembly 10' comprises structural and operational modifications of the casing 30' which affect the creation of the pattern of fluid flow defined, at least in part, by the plurality of bubbles streams 45. More specifically, the display assembly 10' comprises a fluid regulating assembly generally indicated as 90, which is connected, at least in part, to the lower end of the casing 30'. As best shown in FIG. 5, the fluid regulating assembly 90 includes a plurality of inlets 92 which may vary in number and which are disposed in direct fluid communication with the interior 38' of the casing 30' and the liquid 40 contained therein. Each of the inlets 92 are disposed in communicating relation with a source of fluid, preferably ambient air, by means of an elongated conduit 94 disposed within an elongated chamber 96. For purposes of clarity, the term ambient air is, in at least one embodiment, meant to describe air on the exterior of the casing which is not pressurized or otherwise forced to flow into the casing 30, except when sufficient negative pressure exists within the casing 30.

A flow or control valve or like structure 98 allows fluid flow into the elongated conduit 94 and through the various inlets 92, so as to create the aforementioned predetermined pattern of fluid flow 45 and the plurality of bubbles streams of which it is comprised. The fluid regulating assembly 90 also includes a plurality of valves 93 each of which is operatively associated with at least one of the fluid inlets 92. Further, each of the valves 93 may be structured as a one-way or check valve disposed and structured to allow the flow of ambient air, or other fluid, into the interior 38' and liquid 40, through corresponding inlets 92. The flow of liquid 40 back through the valves 93 will be prevented due to their one way structuring.

Figure 6:
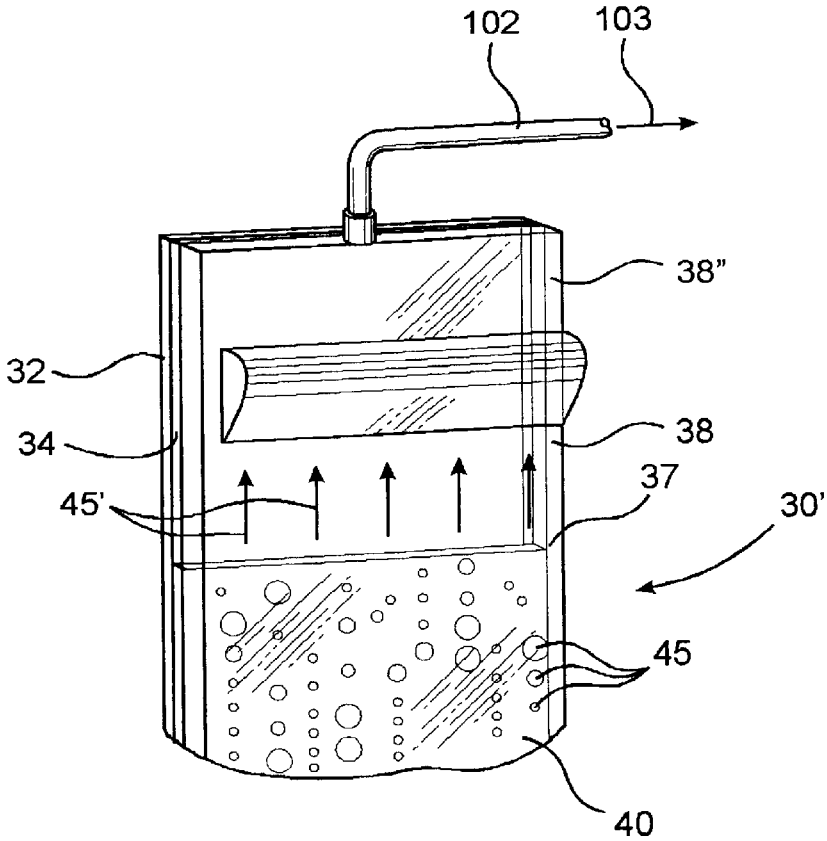
FIG. 6 is a perspective view in partial cutaway of a portion of the casing of the preferred embodiment of FIG. 4.

With reference to FIGS. 4 and 6, the display assembly 10' of the present invention also comprises a source of negative pressure such as a negative pressure or vacuum pump 100 being connected by an appropriate conduit 102 to the interior 38' of the casing 30'. A negative pressure is thereby created within the interior 38' of the casing 30 as the conduit 102 is preferably connected to an upper end of the casing 30' as best shown in FIG. 6. A sufficient negative pressure is continuously maintained within the interior 38' of the casing 30' to facilitate the passage of the pattern of fluid flow 45 upwardly from the plurality of inlets 92 along a significant portion of the length of the casing 30' and throughout substantially the entire body of liquid 40. The creation and maintenance of the negative pressure is schematically indicated by directional arrows 103. The passage of ambient air, in the form of the bubble streams or pattern of fluid flow 45, passes through the liquid and exits from the upper surface of the liquid 40 as at 41. Directional arrows 45' are representative of the air exiting from the liquid 40 and passing through the conduit 102 to the vacuum or negative pressure pump 100.

A pump regulator or adjustment facility is indicated as 54' and is mounted at any convenient location on the housing 12 so as to regulate the vacuum or negative pressure generated by the pump 100. It should be apparent that a change in the negative pressure present within the interior 38' of the casing 30' regulates the speed of flow of the pattern of fluid flow or bubble stream 45. The simulation of moving liquid visually observable from an exterior of the housing 12 can thereby be easily changed dependent, at least in part, by the speed of the plurality of bubbles streams 45 as they pass through the liquid 40. The space 38" is normally left devoid of any liquid 40 but is disposed in direct communication with the connecting end of the conduit 102, wherein the size and precise location of the space 38" may vary.

Another feature further evidencing additional versatility of the preferred embodiment of the display assembly 10' includes the ability to vary or change the appearance and/or configuration of the pattern of fluid flow 45 as it passes through the liquid 40. More specifically, the number of inlets 92 may of course vary and at least one stream of bubbles 45 issues from each of the plurality of inlets 92. If all the associated valves 93 are in an open position there will be a substantially planar pattern of fluid flow defined by the plurality of individual bubble streams 45 being at least partially aligned. The bubble streams will substantially correspond in number to the number of inlets 92, as set forth above. However, the individual valves 93 may be selectively or automatically regulated so as to be independently disposable between an open or a closed position.

Therefore, the overall visual configuration of the predetermined pattern of fluid flow may vary by allowing certain ones of the valves 93 to be opened while others of the plurality of valve 93 are closed. An almost infinite variety of patterns of fluid flow may be developed in that valves 93 may be successively opened or closed in accordance with a different planned sequence. By way of example only, alternate ones of the valves 93 may be opened so as to allow ambient air or other fluid to pass there through. After a predetermined time the opened valves would be closed and the previously closed valves 93 would be opened so as to change the pattern of fluid flow as should be apparent. Alternatively, the inlets 92 located closest to the end of the conduit 96 may be opened while the inlets and associated valves 92, 93 located at the center of the chamber 96 may be closed. The sequence of opening and closing the valves 93 may of course be changed accordingly and the occurrence of opening and closing different valves may be on a timed or preprogramed basis.

Figure 7:
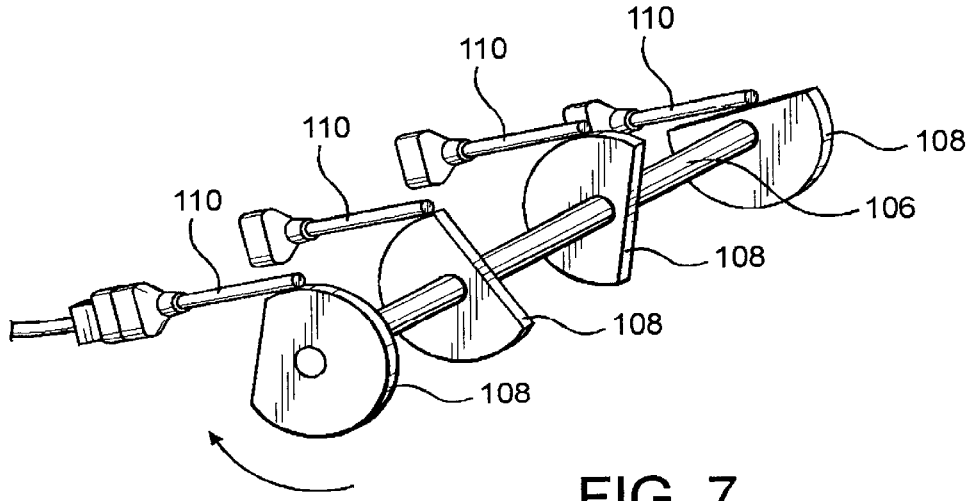
FIG. 7 is a perspective view of another embodiment of the fluid regulating assembly of the present invention.

Therefore, as shown in FIG. 7 each of the valves 93 may be mechanically controlled through the provision of a drive shaft 106 including a plurality of cam members 108 mounted thereon. Each of the cam members 108 are cooperatively structured to engage corresponding valve actuators 110. Each of the valve actuators 110 may be connected to one of a plurality of valves 93 so as to periodically or sequentially open and close the valves.

Figure 8:
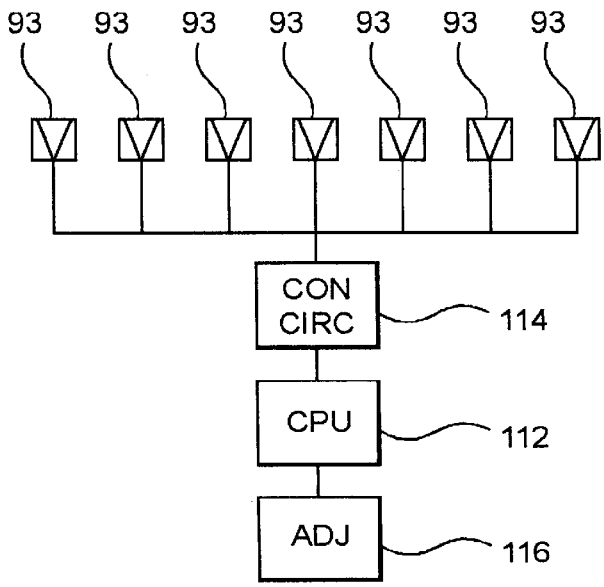
FIG. 8 is a schematic view of yet another embodiment of the fluid regulating assembly of the present invention.

Yet another embodiment of the display assembly 10' is disclosed in FIG. 8 and includes an automatic regulation of the opening and closing of the valves 93 through the provision of a processor 112 connected to appropriate control circuitry 114 which serves to provide electrical signals to each of the valves 93 to facilitate their opening and closing on a pre-programed basis. An appropriate adjustment facility 116 can be utilized to pre-program or otherwise regulate the processor 112 in order to easily vary the pattern of fluid flow of the plurality of bubble streams 45 passing through the liquid 40.

Figure 9:
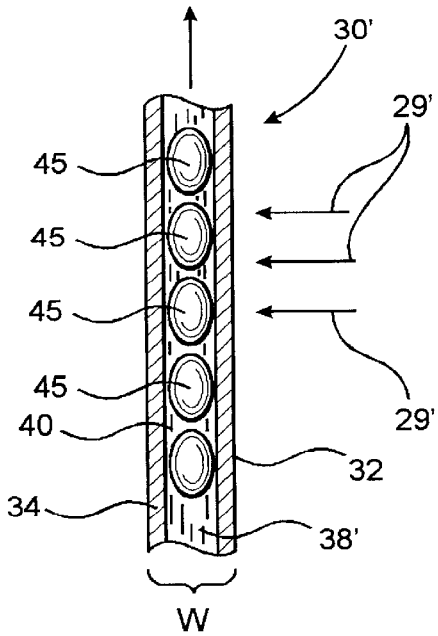
FIG. 9 is a side view in partial cutaway of the casing associated with the embodiment of FIG. 4.

Yet another feature of the present invention is disclosed in FIG. 9 wherein the casing 30' comprises a plurality of spaced apart segments 32 and 34 being disposed in relatively close but spaced proximity to one another. Accordingly, the spacing between the casing segments 32 and 34 defines the dimension of the casing interior 38' to be relatively small and more specifically to be of a dimension which substantially corresponds to the dimension of the plurality of bubbles 45 or the bubble stream which the bubbles 45 define. While the precise transverse dimension may vary, a preferred dimension would be in the range of approximately 0.25 inch or less. For purposes of clarity, the transverse dimension or width designated as "W" is provided to indicate the transverse dimension of the interior 38' of the casing 30' substantially corresponding to the width or transverse dimension of the pattern of fluid flow defined by the plurality of bubble streams 45. Accordingly, light 29' passing from the illumination assembly 28 will highlight the plurality of bubble streams 45 thereby providing a more vibrant visual simulation of moving liquid to one viewing the one or more ornamental displays 18 and in particular the light transmittable material 24 through which the liquid 40 and the pattern of fluid flow 45 may be observed.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents. For example, if desired, the fluid 40 itself could be circulated into the chamber to give the effects of pouring into a container.

Now that the invention has been described,

What is claimed is:

1. A display assembly structured to visually simulate moving liquid, said display assembly comprising:

a) a housing including an illumination assembly, b) a chamber having a hollow interior and including a quantity of liquid contained therein, c) at least one ornamental display disposed in substantially aligned relation with said chamber and said liquid, d) a fluid regulating assembly connected to said chamber and structured to regulate fluid flow into said interior of said chamber, e) a tangible source of negative pressure connected in fluid communication with said interior and structured to deliver a negative pressure therein, and f) said illumination assembly disposed on said housing in illuminating relation to said liquid.

2. A display assembly as recited in claim 1 wherein said fluid regulating assembly is structured and disposed to create a predetermined pattern of fluid flow through said liquid upon a negative pressure existing within said interior.

3. A display assembly as recited in claim 2 wherein said fluid regulating assembly is structured to selectively vary said predetermined pattern of fluid flow through said liquid.

4. A display assembly as recited in claim 1 wherein said fluid regulating assembly comprises a plurality of fluid inlets connected in communicating relation to said interior and collectively disposed to create a predetermined pattern of fluid flow through said liquid upon a negative pressure existing within said liquid.

5. A display assembly as recited in claim 4 wherein said fluid regulating assembly further comprises a valve assembly connected to said plurality of fluid inlets and structured to regulate fluid flow there through into said interior.

6. A display assembly as recited in claim 5 wherein said valve assembly comprises a plurality of valves connected to said plurality of fluid inlets and cooperatively structured therewith to regulate independent fluid flow through each of said plurality of fluid inlets into said interior.

7. A display assembly as recited in claim 6 wherein each of said plurality of valves comprises a one-way valve connected to and cooperatively structured with one of said plurality of fluid inlets so as to prevent liquid flow there through from said interior.

8. A display assembly as recited in claim 4 wherein said plurality of fluid inlets are disposed in fluid communication between said interior and ambient air exteriorly of said chamber.

9. A display assembly as recited in claim 8 wherein said fluid regulating assembly further comprises a valve assembly connected to said plurality of fluid inlets and structured to regulate ambient airflow there through into said interior.

10. A display assembly as recited in claim 9 wherein said valve assembly comprises a plurality of valves connected to said plurality of fluid inlets and cooperatively structured therewith to regulate independent ambient air flow through each of said plurality of fluid inlets into said interior.

11. A display assembly as recited in claim 10 wherein said plurality of valves are independently operable to regulate ambient air flow there through in a manner which facilitates variance of said pattern of fluid flow through said liquid.

12. A display assembly as recited in claim 10 wherein each of said valves are independently operable to selectively regulate ambient air flow through at least one of said plurality of fluid inlets and thereby selectively vary said pattern of fluid flow through said liquid.

13. A display assembly as recited in claim 1 wherein at least a portion of said at least one ornamental display is structured to facilitate viewing of said liquid there through; said illumination assembly disposed in substantially aligned relation with said chamber.

14. A display assembly as recited in claim 13 further comprising a plurality of ornamental displays each independently disposable in aligned relation with said chamber and said illumination assembly to facilitate independent viewing thereof and said liquid there through.

15. A display assembly as in claim 1 further comprising an exposed face at least partially formed of transparent material and connected to said housing in overlying relation to said at least one ornamental display.

16. A display assembly structured to visually simulate moving liquid, said display assembly comprising:

a) a chamber having a hollow interior and including a quantity of liquid contained therein, b) at least one ornamental display disposed in visually aligned relation with said chamber and said liquid, c) a fluid regulating assembly connected to said chamber and structured to regulate ambient air flow into said interior of said chamber, d) a tangible source of negative pressure connected in fluid communication with said interior and structured to deliver a negative pressure therein; and e) said fluid regulating assembly structured and disposed to create a predetermined pattern of fluid flow through said liquid upon a negative pressure existing within said interior.

17. A display assembly as recited in claim 16 wherein said fluid regulating assembly is structured to vary the pattern of fluid flow through said liquid.

18. An assembly as recited in claim 16 wherein said fluid regulating assembly comprises a plurality of fluid inlets connected in communicating relation to said interior and collectively disposed to at least partially define a configuration of said predetermined pattern of fluid flow.

19. A display assembly as recited in claim 18 wherein said fluid regulating assembly further comprises a valve assembly connected to said plurality of fluid inlets and structured to regulate ambient air flow there through into said interior to define said pattern of fluid flow.

20. A display assembly as recited in claim 19 wherein said valve assembly comprises a plurality of valves connected to said plurality of fluid inlets and cooperatively structured therewith to regulate independent ambient air flow through each of said plurality of fluid inlets in a manner which facilitates variance of said predetermined pattern of fluid flow.

21. A display assembly as recited in claim 20 wherein said plurality of valves are independently operable to regulate ambient air flow through at least one of said plurality of fluid inlets and thereby vary said predetermined pattern of fluid flow through said liquid.

22. An assembly as recited in claim 16 wherein said interior of said chamber comprises a substantially elongated configuration, said fluid regulating assembly located at a substantially lower end of said chamber so as to direct said predetermined pattern of fluid flow through at least the majority of said liquid from said lower end of said chamber.

23. A display assembly as recited in claim 22 wherein said predetermined pattern of fluid flow extends from said fluid regulating assembly to an upper surface of said liquid.

24. A display assembly as recited in claim 23 wherein said source of negative pressure is connected in direct fluid communication with said interior of said chamber between said upper surface of said liquid and an upper end of said chamber.

25. A display assembly as recited in claim 24 wherein at least a portion of said interior of said chamber comprises a reduced transverse dimension extending along the length of said chamber, said transverse dimension substantially corresponding to a transverse dimension of said predetermined pattern of fluid flow.

26. A display assembly structured to visually simulate moving liquid, said display assembly comprising:

a) a housing having an illumination assembly connected thereto, b) a chamber disposed in illuminated relation to said illumination assembly and having a hollow interior and containing a quantity of liquid, c) at least one ornamental display disposed in visual alignment with said chamber and said liquid therein, d) a fluid regulating assembly connected to said chamber and structured to regulate fluid flow into said interior and through said liquid, e) said fluid regulating assembly structured and disposed to create a predetermined pattern of fluid flow through said liquid, said fluid regulating assembly operable to vary the configuration of said predetermined pattern of fluid flow and the appearance of said ornamental display;

(f) a tangible source of negative pressure connected in fluid communication with said interior and structured to deliver a sufficient negative pressure thereinto facilitate passage of said predetermined pattern of fluid flow through said liquid.

27. A display assembly as recited in claim 26 wherein said fluid regulating assembly comprises a plurality of fluid inlets connected in communicating relation to said interior and collectively disposed to create said predetermined pattern of fluid flow through said liquid upon the existence of negative pressure within said chamber.

28. A display assembly as recited in claim 27 wherein said fluid regulating assembly further comprises a valve assembly connected to said plurality of fluid inlets and structured to regulate fluid flow there through into said interior.

29. A display assembly as recited in claim 28 wherein said valve assembly comprises a plurality of valves connected to said plurality of fluid inlets and cooperatively structured therewith to regulate independent fluid flow through each of said plurality of fluid inlets into said interior and through said liquid.

30. A display assembly as recited in claim 26 further comprising a plurality of ornamental displays each independently disposable in visually aligned relation with said chamber and said illumination assembly to facilitate independent viewing thereof and said liquid there through.

31. A display assembly as recited in claim 30 wherein at least a portion of said interior of said chamber comprises a reduced transverse dimension extending along a length of said chamber and substantially corresponding to a transverse dimension of said predetermined path of fluid flow.

32. A display assembly as recited in claim 31 further comprising a source of negative pressure connected in fluid communication with said interior and structured to create a sufficient negative pressure therein to facilitate passage of said predetermined pattern of fluid flow through said liquid.

33. A display assembly as recited in claim 26 wherein at least a portion of said interior of said chamber comprises a reduced transverse dimension extending along a length of said chamber and substantially corresponding to a transverse dimension of said predetermined path of fluid flow.

* * * * *